US010114314B2

(12) United States Patent
Nakamura

(10) Patent No.: US 10,114,314 B2
(45) Date of Patent: Oct. 30, 2018

(54) POWDER COLLECTING DEVICE AND IMAGE FORMING APPARATUS INCORPORATING SAME

(71) Applicant: Kenji Nakamura, Kanagawa (JP)

(72) Inventor: Kenji Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/652,357

(22) Filed: Jul. 18, 2017

(65) Prior Publication Data

US 2018/0074440 A1 Mar. 15, 2018

(30) Foreign Application Priority Data

Sep. 13, 2016 (JP) ..... 2016-178185

(51) Int. Cl.
*G03G 15/08* (2006.01)
*G03G 15/095* (2006.01)

(52) U.S. Cl.
CPC ..... *G03G 15/0891* (2013.01); *G03G 15/095* (2013.01)

(58) Field of Classification Search
None
See application file for complete search history.

(56) References Cited

U.S. PATENT DOCUMENTS 9,829,851 B2 * 11/2017 Okura ..... G03G 21/0011
2008/0095559 A1 4/2008 Shimizu et al.
2015/0050057 A1 * 2/2015 Sato ..... G03G 15/0879 399/358
2015/0063887 A1 * 3/2015 Asaoka ..... G03G 21/105 399/353
2017/0139353 A1 5/2017 Sakashita et al.

FOREIGN PATENT DOCUMENTS

JP 2008-122925 5/2008
JP 2011-112676 6/2011

* cited by examiner

*Primary Examiner* — Victor Verbitsky
(74) *Attorney, Agent, or Firm* — Oblon, McClelland, Maier & Neustadt, L.L.P.

(57) ABSTRACT

A powder collecting device includes an inlet through which powder flows in the powder collecting device, and a conveying screw to rotate to convey the powder inside the powder collecting device. The conveying screw includes a shaft and a screw portion spirally winding around the shaft. The powder collecting device further includes a flexible sheet including a plurality of strip portions divided by a plurality of slits spaced apart in an axial direction of the conveying screw. Each of the strip portions includes a contact portion to contact the shaft of the conveying screw. The contact portion is shifted from an end of the flexible sheet.

10 Claims, 4 Drawing Sheets

FIG. 7A
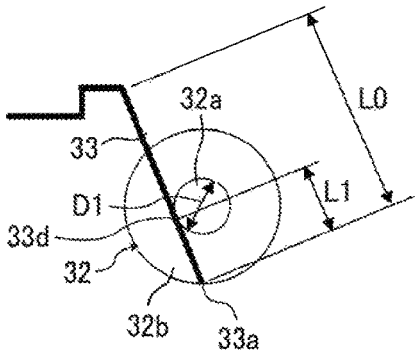
FIG. 7B
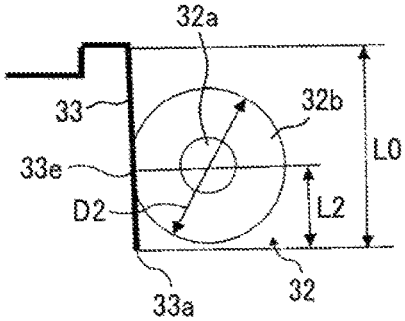
FIG. 8
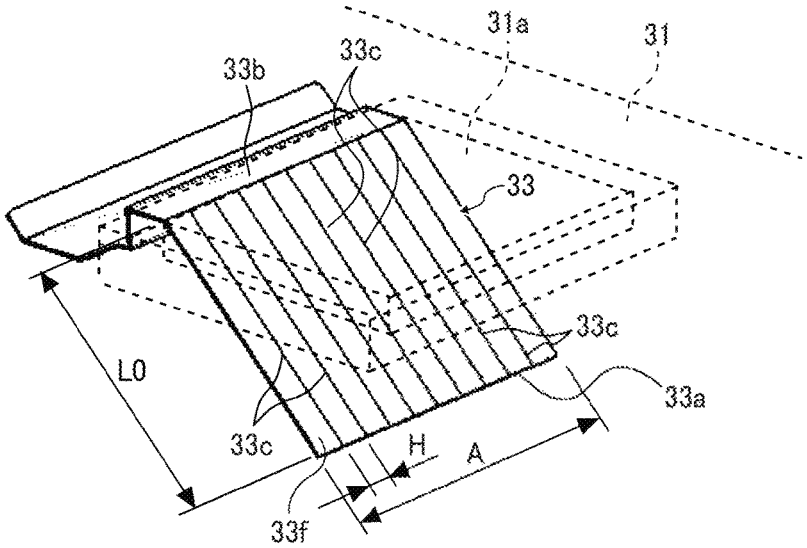
FIG. 9
| L0 | L1 | L2 | D1 | D2 | NOISE |
|---|---|---|---|---|---|
| 13 mm | 1 mm | 2 mm | 5 mm | 11 mm | OCCURRED |
| 15 mm | 3 mm | 4 mm | | | NONE |
| 17 mm | 5 mm | 6 mm | | | NONE |

POWDER COLLECTING DEVICE AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application No. 2016-178185, filed on Sep. 13, 2016, in the Japan Patent Office, the entire disclosure of which is hereby incorporated by reference herein.

BACKGROUND

Technical Field

This disclosure generally relates to a powder collecting device to collect powder such as toner and an image forming apparatus such as a copier, a facsimile machine, a printer, or a multifunction peripheral (MFP) having at least two of copying, printing, facsimile transmission, plotting, and scanning capabilities and incorporating the powder collecting device.

Description of the Related Art

There are apparatuses including a powder collecting device to store waste toner flowing through an inlet. In a case of an image forming apparatuses, such as copiers and printers, the powder collecting device is, for example, a waste-toner container removably mounted in the apparatus to collect untransferred toner (residual toner) removed by at least one cleaning device, from at least one image bearer (e.g., a photoconductor or an intermediate transfer belt) after a transfer process. The collected toner (i.e., waste toner) is conveyed through a conveyance passage and stored in the waste-toner container.

The waste-toner container includes a conveying screw disposed below the inlet to move the waste toner away from the inlet and distribute the waste toner throughout the waste-toner container.

SUMMARY

According to an embodiment of this disclosure, a powder collecting device includes an inlet through which powder flows in the powder collecting device, and a conveying screw to rotate to convey the powder inside the powder collecting device. The conveying screw includes a shaft and a screw portion spirally winding around the shaft. The powder collecting device further includes a flexible sheet including a plurality of strip portions divided by a plurality of slits spaced apart in axial direction of the conveying screw. Each of the strip portions includes a contact portion to contact the shaft of the conveying screw. The contact portion is shifted from an end of the flexible sheet.

According to another embodiment, an image forming apparatus includes an image bearer, at least one cleaning device to collect toner from an image bearer, a conveyance passage in which the toner collected is conveyed, and the powder collecting device according to claim 1, to be coupled to the conveyance passage.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 7A is a schematic cross-sectional view of a flexible sheet illustrated in FIG. 4, being in contact with a shaft of a conveying screw;

FIG. 7B is a schematic cross-sectional view of the flexible sheet illustrated in FIG. 4, being in contact with a periphery of the conveying screw;

FIG. 8 is a schematic perspective view of the flexible sheet illustrated in FIG. 4; and FIG. 9 is a table illustrating a relation between dimensions of the flexible sheet and the conveying screw and noise according to an experiment.

Figure 1:
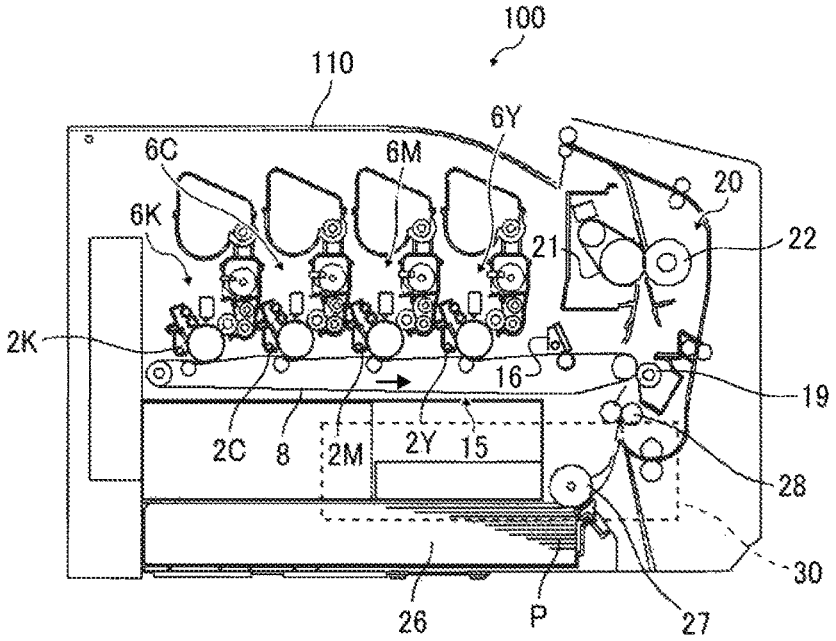
FIG. 1 is a schematic diagram illustrating a configuration of an image forming apparatus according to an embodiment.

The accompanying drawings are intended to depict embodiments of the present invention, and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of the present invention is described. As used herein, the singular forms "a", "an", and "the" are intended to include the plural forms as well unless the context clearly indicates otherwise.

The suffixes Y, M, C, and K reached to each reference numeral indicate only that components indicated thereby are used for forming yellow, magenta, cyan, and black images, respectively, and hereinafter may be omitted when color discrimination is not necessary.

Figure 2:
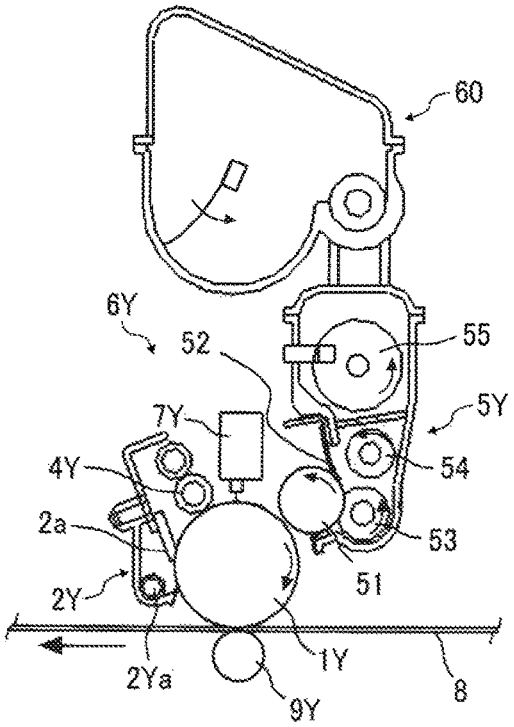
FIG. 2 is a cross-sectional view of a process cartridge and a vicinity thereof in the image forming apparatus illustrated in FIG. 1.

Referring to FIGS. 1 and 2, configuration and operation of an intake forming apparatus 100 according to the present embodiment is described below.

As illustrated in FIG. 1, the image forming apparatus 100 includes an intermediate transfer belt device 15 at a center of a body thereof (i.e. an apparatus body). The image forming apparatus 100 further includes process cartridges 6Y, 6M, 6C, and 6K, respectively corresponding to yellow, magenta, cyan, and black, disposed facing an intermediate transfer belt 8 (e.g., an image bearer) of the immediate transfer belt device 15. The process cartridges 6Y, 6M, 6C and 6K are collectively referred to as "process cartridges 6". Below the intermediate transfer belt device 15, a waste-toner collecting device 30, serving as a powder collecting device, is deposed.

Referring to FIG. 2, the process cartridge for 6Y for yellow includes a photoconductor drum 1Y serving as an image bearer and further includes a charging device 4Y, a developing device 5Y, and a cleaning device 2Y disposed around the photoconductor drum 1Y, which are united and removable (replaceable) from the image forming apparatus 100 at a time. Image forming process, namely, charging, exposure, development, transfer, and cleaning processes are performed on the photoconductor drum 1Y, and thus a yellow image is formed on the photoconductor drum 1Y. The process cartridge 6Y and a primary transfer roller 9Y (a transfer device) together serve as an image forming device.

Note that other process cartridges 6M, 6C, and 6K (image forming devices) have a similar configuration to that of the yellow process cartridge 6Y except the color of the toner used therein and form magenta, cyan, and black toner images, respectively. Thus, only the process cartridge 6Y is described below and descriptions of other process cartridges 6M, 6C, and 6K are omitted.

Referring to FIG. 2, the photoconductor drum 1Y (an image bearer) is rotated clockwise in FIG. 2 by a main motor. At a position where the photoconductor drum 1Y opposes the charging device 4Y (e.g., a charging roller), the charging device 4Y charges the surface of the photoconductor drum 1Y uniformly (a charging process).

Subsequently, at an irradiation position with exposure light emitted from an exposure device 7Y (an optical writing head), the photoconductor drum 1Y is scanned with the exposure light, and thus an electrostatic latent image tor yellow is formed thereon (an exposure process).

Then, the photoconductor drum 1Y reaches a position facing the developing device 5Y, where the electrostatic latent image is developed with toner into a yellow toner image (development process).

When the surface of the photoconductor drum 1Y carrying the toner image reaches a position facing the primary transfer roller 9Y via the intermediate transfer belt 8, the toner image is transferred onto the intermediate transfer belt 8 (a primary transfer process). After the primary transfer process, a certain amount of toner tends to remain untransferred on the photoconductor drum 1Y.

When the surface of the photoconductor drum 1Y reaches a position facing the cleaning device 2Y, a cleaning blade 2*a* collects the untransferred toner from the photoconductor drum 1Y into the cleaning device 2Y (a cleaning process). The cleaning device 2Y includes a conveying coil 2Y*a* to convey the collected toner therein, in a direction perpendicular to the surface of the paper on which FIGS. 1 and 2 are drawn. The collected toner is transported through a waste-toner conveyance section 40 illustrated in FIG. 3 and stored as waste toner in the waste-toner collecting device 30.

Subsequently, a discharger removes residual potentials from the photoconductor drum 1Y.

Thus, a sequence of image forming processes performed on the photoconductor drum 1Y is completed.

The above-described image forming processes are performed in the process cartridges 6M, 6C, and 6K similarly to the yellow process cartridge 6Y. That is, the exposure devices 7 disposed above the process cartridges 6M, 6C and 6K emit exposure light according to image data onto respective photoconductor drums 1 in the process cartridges 6M, 6C, and 6K.

Then, the toner images formed on the photoconductor drums 1 through the development process are transferred therefrom and superimposed one on another on the intermediate transfer belt 8. Thus, a multicolor toner image is defined on the intermediate transfer belt 8.

Referring back to FIG. 1, the intermediate transfer belt device 15 includes the intermediate transfer belt the four primary transfer rollers 9 (see FIG. 2), a driving roller, and a driven roller. The intermediate transfer belt 8 is supported by and entrained around the driving roller, the driven roller, and the primary transfer rollers 9. As the driving roller rotates, the intermediate transfer belt 8 rotates in the direction (clockwise in FIG. 1) indicated by arrow illustrated in FIG. 1.

The primary transfer roller 9Y nips the intermediate transfer belt 8 together with the photoconductor drum 1Y. A contact portion therebetween is referred to a primary transfer nip. A transfer voltage (a primary transfer bias) opposite in polarity to the toner is applied to the primary transfer roller 9Y.

The intermediate transfer belt 8 rotates in the direction indicated by the arrow in FIG. 1 and sequentially passes through the primary transfer nips, that is, passes by the primary transfer rollers 9. Then, toner images of the respective colors are transferred from the photoconductor drums 1 primarily and superimposed one on another into a four-color image, on the intermediate transfer belt 8.

Then, the intermediate transfer belt 8 carrying the superimposed toner image reaches a position opposing a secondary transfer roller 19 (secondary transfer device). The intermediate transfer belt 8 is nipped between the secondary transfer roller 19 and the driving roller (i.e., a secondary transfer backup roller), and the contact portion therebetween is referred to as a secondary transfer nip. The four-color toner image on the intermediate transfer belt 8 is transferred onto a recording medium P (e.g., a paper sheet) transported to the secondary transfer nip (a secondary transfer process). A certain amount of toner tends to remain untransferred on the intermediate transfer belt 8 after the secondary transfer process.

Subsequently, at a position opposing a cleaning device 16 for intermediate transfer, the untransferred toner is mechanically collected from the intermediate transfer belt 8 by a cleaning blade pressing against the intermediate transfer belt 8. The cleaning blade is made of an elastic material such as urethane rubber and shaped like a plate. The cleaning blade is pressed against the intermediate transfer belt 8 with a predetermined pressure and at a predetermined angle. Similar to the cleaning device 2 for the photoconductor drum 1, the cleaning device 16 includes a conveying coil to convey the collected toner therein, in a direction perpendicular to the surface of the paper on which FIGS. 1 and 2 are drawn. The toner collected from the intermediate transfer belt 8 is transported thorough the waste-toner conveyance section 40 illustrated in FIG. 3 and stored as waste toner in the waste-toner collecting device 30. The waste-toner collecting device 30 (the powder collecting device) is described in further detail later, with reference to FIGS. 3 through 8.

Thus, a sequence of image forming processes performed on the intermediate transfer belt 8 is completed.

Referring back to FIG. 1, the recording medium P is transported from a sheet feeding tray 26 disposed in a lower portion of the image forming apparatus 100 to the secondary transfer nip, via a sheet feeding roller 27 and a registration roller pair 28 (a timing roller pair).

More specifically, the sheet feeding tray 26 contains multiple recording media P (e.g., paper sheets) piled one on another. The sheet feeding roller 27 rotates counterclockwise in FIG. 1 to feed the top sheet of the recording media P in the sheet feeding tray 26, toward a nip between the registration roller pair 28.

The registration roller pair 28 stops rotating temporarily, stopping the recording medium P with a leading end of the recording medium P stuck in the nip. The registration roller pair 28 rotates to transport the recording medium P to the secondary transfer nip, timed to coincide with the arrival of the multicolor toner image formed on the intermediate transfer belt 8. Thus, the multicolor toner image is transferred onto the recording medium P.

Subsequently, the recording medium P carrying the multicolor image is transported to a fixing nip in a fixing device 20. In the fixing device 20, a fixing belt 21 (a fixing rotator) and a pressure roller 22 (a pressure rotator) apply heat and pressure to the recording medium P to fix the multicolor toner image on the recording medium P (fixing process).

Subsequently, the recording medium P is discharged by a discharge roller pair outside the image forming apparatus 100. The recording media P are sequentially stacked as output images on a stack tray (i.e., an apparatus cover 110).

Thus, a sequence of image forming processes performed in the image forming apparatus is completed.

Next, image forming devices are described in further detail below with reference to FIG. 2.

As Illustrated in FIG. 2, the process cartridge 6Y includes the photoconductor drum 1Y, the charging device 4Y (a charging roller), the developing device 5Y, and the cleaning device 2Y.

The photoconductor drum 1Y serving as the image bearer is a negatively charged organic photoconductor and is rotated clockwise in FIG. 2 by the main motor disposed on an apparatus side (not process-cartridge side).

The charging device 4 is an elastic charging roller and includes and an elastic layer of moderate resistivity, covering the core. For example, the elastic layer is a formed urethane layer that includes urethane resin, carbon black, as conductive particles, a sulfuration agent, and a foaming agent.

The cleaning device 2Y includes the cleaning blade 2*a* that slidingly contacts the photoconductor drum 1Y and mechanically removes the toner from the photoconductor drum 1Y. The cleaning blade 2*a* is made of an elastic material such as urethane rubber and shaped like a plate. The cleaning blade 2*a* is pressed against the photoconductor drum 1Y with a predetermined pressure, at a predetermined angle.

The developing device 5Y includes a developing roller 51 serving as a developer bearer that slidingly contacts the photoconductor drum 1Y, and a developing range is generated therebetween. The developing device 5Y contains one-component developer, that is, toner (either magnetic or nonmagnetic). The developing device 5Y develops the electrostatic latent image on the photoconductor drum 1Y into a toner image.

The developing device 5Y includes the developing roller 51, a supply roller 53, a doctor blade 52, and conveying screws 54 and 55. On an upper side of the developing device 5Y in FIG. 2, a toner container 60 is removably mounted, to supply toner (fresh toner) to the developing device 5Y.

Next, a configuration and operation of the waste-toner collecting device 30 are described in further detail below.

In FIG. 1, the waste-toner collecting device 30 is removably mounted inside the image forming apparatus 100 and disposed below the intermediate transfer belt device 15 and on a front side of the image forming apparatus 100 (on the front side of the paper on which FIG. 1 is drawn).

Figure 3:
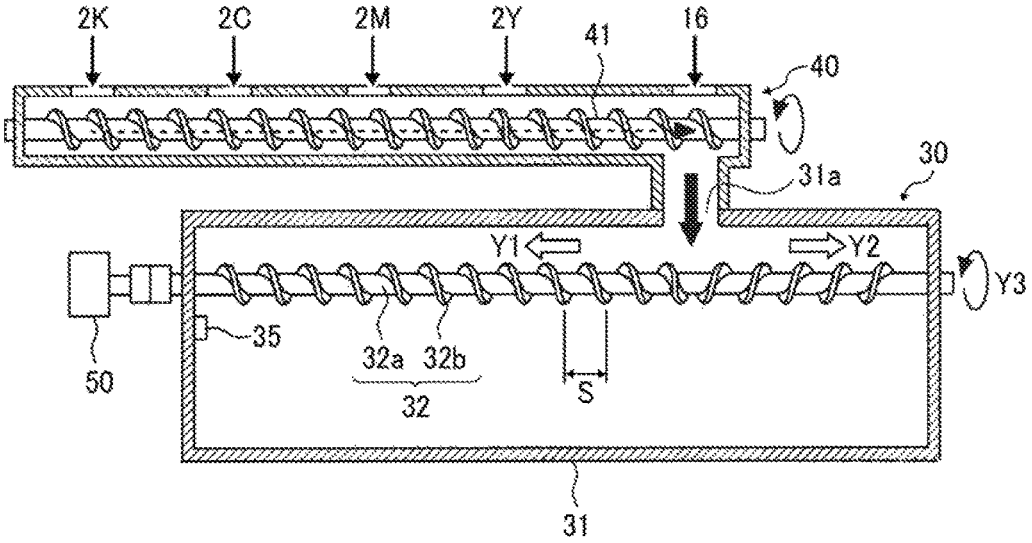
FIG. 3 is a schematic cross-sectional view illustrating a waste-toner collecting device according to an embodiment, coupled to a waste toner conveyance section.

In the present embodiment, the waste-toner collecting device 30 is removably mountable in the image forming apparatus 100 (or the waste-toner conveyance section 40 illustrated in FIG. 3). When the waste-toner collecting device 30 is filled to capacity with the waste toner (a full-state sensor 35 disposed at a predetermined height detects the waste toner), the waste-toner collecting device 30 is replaced with new (empty) one. Specifically, for the replacement, an apparatus door on the right in FIG. 1 is opened to expose an interior of the image forming apparatus 100. In this state, the waste-toner collecting device 30 is removed from and mounted into the apparatus body in a width direction of the apparatus, which is lateral in FIGS. 1 and 3 and perpendicular to (penetrating) the surface of the paper on which FIG. 4 is drawn.

Figure 4:
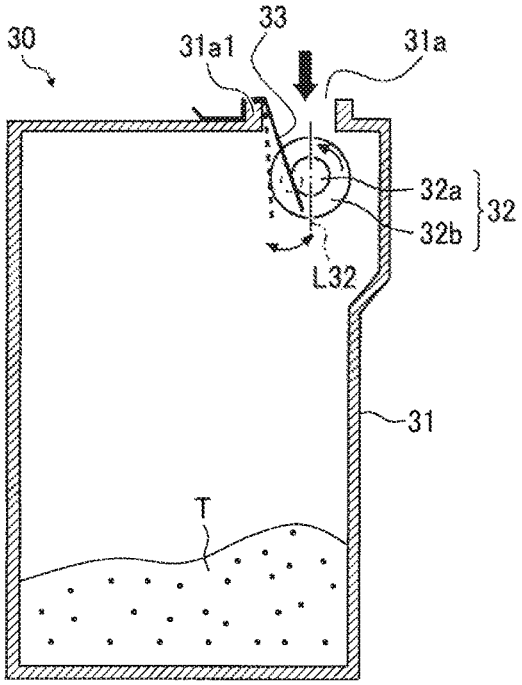
FIG. 4 is a cross-sectional view of the waste-toner collecting device illustrated in FIG. 3, on a cross section perpendicular to a width direction of the image forming apparatus illustrated in FIG. 1.

Referring to FIGS. 3 and 4, the waste-toner collecting device 30 (the powder collecting device) extends in the width direction (lateral in FIGS. 1 and 3 and penetrating FIG. 4) of the apparatus and rectangular in cross section. The longitudinal direction of the waste-toner collecting device 30 accords with the axial direction of a conveying screw 32 disposed therein.

As illustrated in FIG. 3, an inlet 31*a* (an opening) is disposed at a ceiling of a container body 31 (a housing) of the waste-toner collecting device 30. In the waste-toner collecting device 30, the inlet 31*a* is closer to one end (the right end in FIG. 3) than a center is the width direction of the apparatus. As the waste-toner collecting device 30 is mounted in the image forming apparatus 100, the inlet 31*a* communicates with the waste-toner conveyance section 40 serving as a conveyance passage on the apparatus side.

Referring to FIG. 3, the waste-toner conveyance section 40 is a conveyance passage through which the waste toner (i.e., powder), collected by a plurality of cleaning devices, is conveyed toward the waste-toner collecting device 30. The waste-toner conveyance section 40 includes a waste-toner conveying screw 41 that rotates in a predetermined direction to convey the waste toner from the left to the right in FIG. 3. The waste-toner conveyance section 40 has a plurality of connections coupled to respective outlets of the cleaning devices 2K, 2C, 2M, 2Y, and the cleaning device 16, arranged in that order in the conveyance direction of the waste-toner conveying screw 41. That is, the connection to the cleaning device 2K is extreme upstream, and the connection to the cleaning device 2C is next to and downstream from the connection to the cleaning device 2K. The connection to the cleaning device 2M is next to and downstream from the connection to the cleaning device 2C, and the connection to the cleaning device 2Y is next to and downstream from the connection to the cleaning device 2M. The connection to the cleaning device 10 for the intermediate transfer belt 8 is extreme downstream and above the inlet 31*a* In FIG. 3.

In a state illustrated in FIG. 3, in which the inlet 31*a* communicates with the waste-toner conveyance section 40 (the conveyance passage), the toner (powder) collected by the five cleaning devices 2Y, 2M, 2C, 2K, and 16 flows through the inlet 31*a* and stored in the waste-toner collecting device 30.

Specifically, the cleaning devices 2Y, 2M 2C, and 2K collect the toner from the photoconductor drums 1 and discharge the collected toner into the waste-toner conveyance section 40. Then, the waste-toner conveying screw 41 conveys the collected toner to the inlet 31*a*, and the toner (waste toner T illustrated in FIG. 4) falls through the inlet 31*a* under the gravity to the waste-toner collecting device 30. Additionally, the cleaning device 16 collects the toner from the intermediate transfer belt 8 and discharges the collected toner to the waste-toner conveyance section 40. The toner (waste toner T) falls through the inlet 31*a* under the gravity to the waste-toner collecting device 30.

Referring to FIGS. 3 and 4, the waste-toner collecting device 30 includes the conveying screw 32 that rotates in a predetermined direction indicated by arrow Y3 (counter-clockwise in FIG. 4) to convey the toner in the waste-toner collecting device 30. The conveying screw 32 includes a shaft 321 having an outer diameter D1 (see FIG. 7A) of about 5 mm and a screw portion 32*b* spirally wiring around the shaft 32*a*. The screw portion 32*b* has an outer diameter D2 (see FIG. 7B) of about 11 mm and a pitch S (between threads) of about 11 mm. The conveying screw 32 is made of either metal or resin material. The conveying screw 32 is provided with a driven coupling on the left in FIG. 3 (back side or downstream side in the direction in which the waste-toner collecting device 30 is mounted in the apparatus). The driven coupling engages a driving coupling at a motor shaft of a motor 50 secured in the image forming apparatus 100. Driven by the motor 50, the conveying screw 32 rotates at a speed of about 40 to 80 revolutions per minute (rpm), thereby conveying the waste toner T in the container body 31 in the directions indicated by arrows Y1 and Y2 in FIG. 3.

More specifically, the conveying screw 32 is disposed in an upper part of the waste-toner collecting device 30 and conveys the waste toner flowing into the waste-toner collecting device 30 horizontally or substantially horizontally. The inlet 31*a* is disposed above the conveying screw 32 and opposing a portion of the conveying screw 32. That is, the inlet 31*a* is shorter than the conveying screw 32 in the axial direction of the conveying screw 32. Accordingly, the waste toner T, which flows through the inlet 31*a* and falls toward the bottom of the container body 31, grazes the conveying screw 33.

Figure 5A:
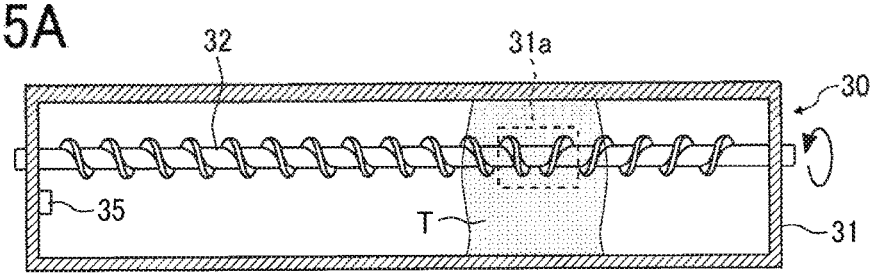
FIG. 5A is a cross-sectional view, from above, of a state in which a small amount of toner is collected in the waste-toner collecting device illustrated in FIG. 4.
Figure 5B:
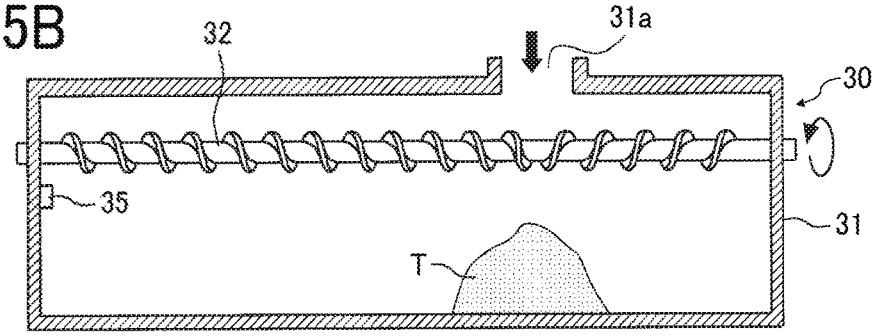
FIG. 5B is cross-sectional view, from a side, of the state illustrated in FIG. 5A.
Figure 6A:
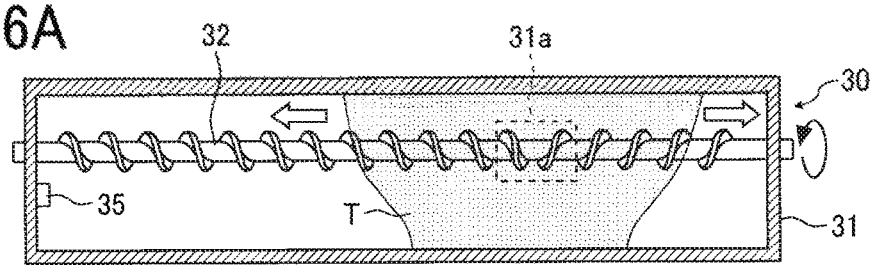
FIG. 6A is a cross-sectional view, from above, of a state in which the amount of toner collected in the waste-toner collecting device is larger than that in FIG. 5A.
Figure 6B:
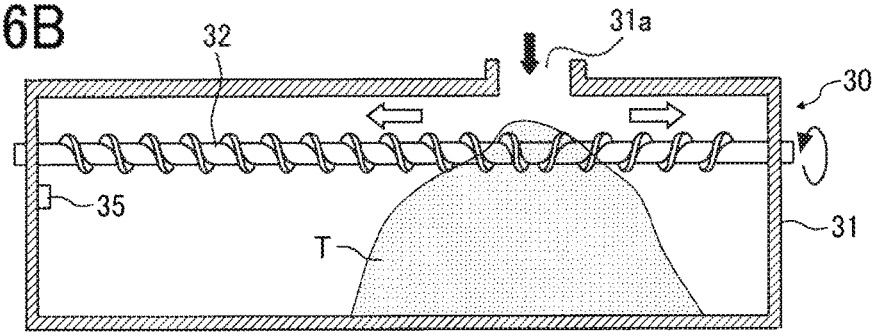
FIG. 6B is a cross-sectional view, from a side, of the state illustrated in FIG. 6A.

Initially, the waste toner T flowing in the waste-toner collecting device 30 (i.e., an empty container) accumulates on the bottom below the inlet 31*a* as illustrated in FIGS. 5A and 5B. When the height of the waste toner T reaches the conveying screw 32 as illustrated in FIGS. 6A and 6B, the conveying screw 32 conveys the waste toner T in both directions of the width direction, as indicated by arrows Y1 and Y2. The full-state sensor 35, for example, a piezoelectric sensor, is disposed at an end of the waste-toner collecting device 30 in the longitudinal direction thereof. As the waste toner T accumulates to the height of the full-state sensor 35, the full-state sensor 35 detects the waste toner T. In this state, the container body 31 is filled to capacity with the waste toner T. In response to the detection by the full-state sensor 35, a display of the image forming apparatus 100 (for example, disposed on an exterior thereof) displays a prompting to replace the waste-toner collecting device 30.

In the waste-toner collecting device 30 according to the present embodiment, the inlet 31*a* is disposed at not an end but a position shifted from the end in the longitudinal direction of the waste toner collecting device 30. In the conveying screw 32, the direction of winding of the screw portion 32*b* reversed at the position of the inlet 31*a*. That is, the screw portion 32*b* includes first and second portions extending from the inlet 31*a* to the opposite ends (indicated by arrows Y1 and Y2), and the screws winding direction is opposite between the first and second portions.

With this configuration, the conveying screw 32 conveys the waste toner T flowing from the inlet 31*a* to both ends in the usual direction thereof so that the waste toner T does not accumulate on one side in the longitudinal direction of the container body 31. Thus, the waste toner T is distributed throughout the container body 31 in the longitudinal direction.

As illustrated in FIGS. 4, 7A, and 7B, the waste-toner collecting device 30 according to the present embodiment includes a flexible sheet 33 that contacts the conveying screw 32.

Referring to FIG. 8, the flexible sheet 33 has a plurality of slits 33*c* (nine slits 33*c* in FIG. 8) arranged, at distances H, in the axial direction of the conveying screw 32. In other words, the flexible sheet 33 is shaped like a comb and is not continuous at an end 33*a*.

The flexible sheet 33 is disposed such that a portion (i.e., a contact portion including a contact position 33*d* or 33*d* in FIGS. 7A and 7B), enclosed by a broken circle in FIG. 4, contacts the shaft 32*a* of the conveying screw 32. As illustrated in FIGS. 4 and 7A, the contact portion located not at the end 33*a* but between the end 33*a* and a base 33*b* (FIG. 8) of the flexible sheet 33 contacts the shaft 32*a*. That is, not the end but a face of the flexible sheet 33 contacts the shaft 32*a*.

With this structure, as the conveying screw 32 rotates, each of strip portions 33*f* divided by the slits 33*c* of the flexible sheet 33 swings back and forth between a first position illustrated in FIG. 7A, at which the intermediate portion contacts the shaft 32*a*, and a second position illustrated in FIG. 7B, at which the intermediate portion contacts a periphery of the screw portion 32*b*. In FIG. 8, the flexible sheet 33 is divided into 10 strip portions 33*f* by the slits 33*c*. Each of the strip portions 33*f* divided by the slits 33*c* swings back and forth between the first position indicated by a solid line and the second position indicated by broken lines in FIG. 4, as indicated by a double-headed arrow.

Specifically, as the conveying screw 32 rotates, each of the strip portions 33*f* divided by the slits 33*c* is deformed into the state illustrated in FIG. 7B from the base 33*b* when blocked by the screw portion 32*b*. By contrast, each of the strip portions 33*f* is not deformed as illustrated in FIG. 7A when the strip portion 33*f* opposes the shaft 32*a*, not the screw portion 32*b*. Each of the strip portions 33*f* divided by the slits 33*c* repeatedly swings as described above, and the cycle of such movement is different between adjacent strip portion 33*f*.

When a given portion of the conveying screw 32 in the axial direction thereof is viewed macroscopically, the surface position of the given portion changes repeatedly, and the strip portion 33*f* of the flexible sheet 33 contacts the given portion almost entirely. Thus, the waste toner T can be scraped off from the surface of the entire conveying screw 32. To the conveying screw 32, mainly the waste toner T falling through the inlet 31*a* adheres directly. Additionally, though the rate is small, when the waste toner T accumulates to the height of the conveying screw 32 in the container body 31, the waste toner T adheres to the conveying screw 32. When the waste toner T firmly adheres to the convoying screw 32, the capability to convey the waste toner T is degraded. The flexible sheet 33 can inhibit such inconvenience. If the conveying capability of the conveying screw 32 is degraded, the waste toner T is not distributed throughout the container body 31. The inlet 31*a* may be clogged, or the waste toner may overflow the inlet 31*a*. Further, the conveying screw 32 may be locked in the waste toner T, causing noise. The flexible sheet 33 can inhibit such inconveniences.

In particular, currently, toner having lower melting point is widely used to save thermal energy consumed in the fixing device 20. Such toner having lower melting point easily solidifies on the conveying screw 32. In such a case, the flexible sheet 33 is more effective.

Additionally, in compact image forming apparatuses, the heat from the fixing device 20 easily reaches the waste-toner collecting device 30, and firm adhesion of the waste toner T to the conveying screw 32 easily occurs. In such a case, the flexible sheet 33 is more effective.

In the present embodiment, not the end 33*a* but the face (of a portion shifted from the end 33*a*) of the flexible sheet 33 contacts the shaft 32*a*. While the flexible sheet 33 is used over a long time, the end 33*a* of the flexible sheet 33 may wear. Due to inaccuracy in dimensions and assembling, the contact state of the flexible sheet 33 with the conveying screw 32 is made different from an intended state. Even such cases, the flexible sheet 33 can swing back and forth and maintain the capability described above.

The inventors have performed an experiment to ascertain whether or not the sound (noise) of contact of the flexible sheet 33 with the conveying screw 32 differs between a case where the end 33*a* of the flexible sheet 33 contacts the shaft 32*a* and a case where the face of the flexible sheet 33 contacts the shaft 32*a*. According to a result of the experiment, the noise is not tolerable in the former case, and noise rarely occurs in the latter case. This result confirms the advantages of disposing the flexible sheet 33 such that the face thereof contacts the shaft 32*a* of the conveying screw 32.

Referring to FIGS. 7A, 7B, and 8, in the flexible sheet 33 according to the present embodiment, a length L1 between the end 33*a* and the contact position 33*d* with the shaft 32*a* of the conveying screw 32) is greater than 1 mm. Further, a movable portion (not secured) between the end 33*a* and the base 33*b* has a length L0. A length L2 is from the contact position 33*e* with the periphery of the screw portion 32*b* to the end 33*a* of the flexible sheet 33.

The inventors have performed an experiment to ascertain whether or not the sound (noise) of contact of the flexible sheet 33 with the conveying screw 32 differs. In the experiment, as illustrated in FIG. 9, the conveying screw 32 having the outer diameter D1 (shaft diameter) of 5 mm and the outer diameter D2 (screw diameter) of 11 mm was used. Further, first, second, and third flexible sheets, which were different in the length L0 of the movable position, the length L1 from the contact position 33*d* with the shaft 32*a* to the end 33*a*, and the length L2 from the contact position 33*e* with the screw portion 32*b* to the end 33*a*, were used. The lengths L0, L1 and L2 are illustrated in FIGS. 7A and 7B. In the first flexible sheet, the length L0, L1, and L2 are 13 mm, 1 mm, and 2 mm, respectively. In the second flexible sheet, the length L0, L1, and L2 are 15 mm, 3 mm, and 4 mm, respectively. In the third flexible sheet, the length L0, L1, and L2 are 17 mm, 5 mm, and 6 mm, respectively.

According to a result of the experiment, the noise occurred when the length L1 was 1 mm, and the noise rarely occurred when the length L1 was 3 mm or 5 mm. Therefore, the length L1 in the flexible sheet 33 is preferably longer than 1 mm.

Further, referring to FIG. 8, in the axial direction of the conveying screw 32, a span A of the flexible sheet 33 substantially accords with the span of the inlet 31*a*.

A main cause of solidification of waste toner on the conveying screw 32 is the waste toner T flowing down the inlet 31*a*, directly to the conveying screw 32. Accordingly, when the flexible sheet 33 covers the span of the inlet 31*a*, adhesion of toner to the conveying screw 32 is efficiently suppressed.

Referring to FIGS. 4 and 8, the base 33*b* of the flexible sheet is secured to and held by the container body 31 (housing) of the waste-toner collecting device 30. Specifically, in the container body 31, a rim 31*a*1 of the inlet 31*a* projects upward. The base 33*b* of the flexible sheet 33 is bent at a plurality of positions (e.g., into a shape like a letter "Z"), following the shape of the rim 31*a*1, and attached to the rim 31*a*1.

The plurality of slits 33*c* extends entirely in the rest of the flexible sheet 33 not secured. The rest of the flexible sheet 33 has the length L0 in FIGS. 7A, 7B, and 8. That is, each slit 33*c* extends in the movable portion extending from the end 33*a* to the boundary with the base 33*b*. With this structure, the strip portions 33*f* divided by the slits 33*c* independently swing back and forth without hindering the movement of another strip portion 33*f*. That is, twist of the flexible sheet 33 is inhibited.

This structure ensures the capability to remove the waste toner T from the conveying screw 32.

Further, in FIG. 4, the flexible sheet 33 is disposed to contact the shaft 32*a* along the direction of rotation of the conveying screw 32. Further, the flexible sheet 33 is disposed to contact the shaft 32*a* in a region (on the left in FIG. 4) where the conveying screw 32 moves downward, of two regions divided by a vertical centerline L32 (alternate long and short dashed lines) on the cross section perpendicular to the axial direction.

Specifically, the flexible sheet 33 contacts the shaft 32*a* at a position lower than (obliquely below) an axis of the conveying screw 32 in a direction trailing to the rotation of the conveying screw 32, as if the flexible sheet 33 goes around under the shaft 32*a*.

With this placement, the flexible sheet 33 does not override the conveying screw 32, and the contact between the face of the flexible sheet 33 with the conveying screw 32 is maintained. This structure ensures the capabilities to remove the waste toner T from the conveying screw 32 and alleviate the noise.

Further, referring to FIGS, 3 and 8, in the present embodiment, the distance H between the slits 33*c* of the flexible sheet 33 in the axial direction of the conveying screw 32 is shorter than the pitch S of the screw portion 32*b* in the axial direction of the conveying screw 32 (S>H).

This structure facilitates the above-described movements of the strip portions 33*f* (divided by the slit 33*c*) repeatedly moving back and forth, individually, at cycles different between adjacent strip portions 33*f*, as the conveying screw 32 rotates. This structure ensures the capabilities to remove the waste toner T from the conveying screw 32.

Referring to FIG. 8, in the present embodiment, the flexible sheet 33 is made of a resin material such as polyethylene terephthalate (PET). For example, the flexible sheet 33 has a thickness in a range from 0.05 mm to 0.2 mm, and the distance H between the slits 33*c* is in a range from 1 mm to 3 mm.

Compared with a flexible sheet made of metal when the flexible sheet 33 is made of a resin material, the sound of contact with the conveying screw 32 is reduced.

When the flexible sheet 33 is thinner than 0.05 mm, the force of contact with the conveying screw 32 is weak and the capability to remove the waste toner T is degraded. By contrast, when the flexible sheet 33 is thicker than 0.2 mm, the rigidity thereof is too high, inhibiting flexible deformation. Then, swinging of the flexible sheet 33 becomes difficult. When the thickness of the flexible sheet 33 is in the range from 0.05 mm to 0.2 mm, such inconveniences are inhibited.

When the distance R between the slits 33*c* is shorter than 1 mm, processing of the slits 33*c* may be difficult. By contrast, when the distance H between the slits 33*c* is longer than 3 mm, the rigidity thereof is too high, inhibiting flexible deformation. Then, swinging of the flexible sheet 33 becomes difficult. When the distance H between the slits 33*c* is in the range from 1 mm to 3 mm, such inconveniences are inhibited.

For example, the flexible sheet 33 is a PET sheet (e.g., Mylar sheet) having a thickness of 0.1 mm, and the slits 33*c* are evenly spaced at the distance H of 2 mm.

As described above, the waste-toner collecting device 30 (powder collecting device) according to the present embodiment includes the flexible sheet 33 disposed such that a portion shifted from the end 33*a* contacts the shaft 32*a* of the conveying screw 32. The flexible sheet 33 includes a plurality of strip portions 33*f* divided by the slits 33*c* arranged at the distances H in the axial direction of the conveying screw 32.

Accordingly, firm adhesion of the waste toner T to the conveying screw 32 is inhibited.

Although the description above concerns the waste-toner collecting device 30 in which the screw position 32*b* of the conveying screw 32 winds around the shaft 32*a* in a normal direction and the reverse direction, application of aspects of this disclosure is not limited thereto. For example, aspects of this disclosure are applicable to a powder collecting device including a conveying screw in which the winding of threads is unidirectional.

Although the description above concerns the waste-toner collecting device 30 having the inlet 31*a* to be coupled to the waste toner conveyance section 40 (a conveyance passage) in which toner collected from the plurality of cleaning devices 2Y, 2M, 2C, 2K, and 16 is conveyed, application of aspects of this disclosure is not limited thereto. Aspects of this disclosure are applicable to a powder collecting device having an inlet to be coupled to a conveyance passage in which toner collected from a single cleaning device is conveyed.

Although the description above concerns the waste-toner collecting device 30 to collect the powdered toner (waste toner) flowing from the inlet 31*a*, application of aspects of this disclosure is not limited thereto. Aspects of this disclosure are applicable to, for example, a powder collecting device to collect fresh toner (e.g., a toner hopper) and a powder collecting device to collect recycle toner (e.g., a developing device). Further, Aspects of this disclosure are applicable to any powder collecting device irrelative to an electrophotographic image forming apparatus.

In such configurations, effects similar to those described above are also attained.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A powder collecting device comprising:

an inlet through which powder flows in the powder collecting device;

a conveying screw to rotate about a rotational axis to convey the powder inside the powder collecting device, the conveying screw including:

a shaft; and a screw portion spirally winding around the shaft; and a flexible sheet including a plurality of strip portions divided by a plurality of slits spaced apart in an axial direction of the conveying screw, each of the strip portions including a contact portion to contact the shaft of the conveying screw, the contact portion shifted from an end of the flexible sheet and disposed below the rotational axis of the shaft of the conveying screw, and an end of the flexible sheet is below a lowest point of the shaft of the conveyance screw.

2. The powder collecting device according to claim 1, wherein the conveying screw is disposed in an upper part of the powder collecting device to convey the powder in a substantially horizontal direction, wherein the inlet is disposed above the conveying screw and opposing the conveying screw, the inlet being shorter than the conveying screw in the axial direction, and wherein, in the axial direction, a span of the flexible sheet corresponds to a span of the inlet.

3. The powder collecting device according to claim 1, wherein a distance between the end of the flexible sheet and the contact portion is greater than 1 mm.

4. The powder collecting device according to claim 1, wherein the flexible sheet includes a base secured to a housing of the powder collecting device, and wherein the plurality of slits extends entirely in a rest of the flexible sheet which is not secured to the housing.

5. The powder collecting device according to claim 1, wherein the flexible sheet is disposed to contact the shaft along a direction of rotation of the conveying screw, and wherein the flexible sheet is disposed to contact the shaft in a region where the conveying screw moves downward of two regions divided by a vertical centerline on a cross section perpendicular to the axial direction.

6. The powder collecting device according to claim 1, wherein a distance between the plurality of slits in the axial direction is shorter than a pitch of the screw portion in the axial direction.

7. The powder collecting device according to claim 1, wherein the flexible sheet is made of a resin material and has a thickness in a range from 0.05 mm to 0.2 mm, and wherein a distance between the plurality of slits in the axial direction is in a range from 1 mm to 3 mm.

8. The powder collecting device according to claim 1, wherein each of the plurality of strip portions is to swing between a first position and a second position as the conveying screw rotates, wherein the contact portion contacts the shaft at the first position, and wherein the contact portion contacts a periphery of the screw portion at the second position.

9. The powder collecting device according to claim 1, wherein the powder is toner, and wherein the inlet is to be coupled to a conveyance passage in which the toner collected from at least one cleaning device is conveyed.

10. An image forming apparatus comprising:

an image bearer;

at least one cleaning device to collect toner from an image bearer;

a conveyance passage in which the toner collected is conveyed; and the powder collecting device according to claim 1, to be coupled to the conveyance passage.

* * * * *